United States Patent [19]

Dakin et al.

[11] Patent Number: 4,757,236

[45] Date of Patent: Jul. 12, 1988

[54] HIGH PRESSURE METAL HALIDE ARC LAMP WITH XENON BUFFER GAS

[75] Inventors: James T. Dakin; Peter D. Johnson, both of Schenectady, N.Y.

[73] Assignee: General Electric Company, Schenectady, N.Y.

[21] Appl. No.: 890,968

[22] Filed: Jul. 29, 1986

Related U.S. Application Data

[63] Continuation of Ser. No. 676,367, Nov. 29, 1984, abandoned.

[51] Int. Cl.[4] ..... H01J 61/22

[52] U.S. Cl. ..... 313/638; 313/643

[58] Field of Search ..... 313/638, 642, 570, 572, 313/643, 637

[56] References Cited

U.S. PATENT DOCUMENTS

| | | | |
|---|---|---|---|
| 3,248,590 | 4/1966 | Schmidt | 313/570 |
| 3,639,801 | 2/1972 | Jacobs et al. | 313/642 |
| 4,146,813 | 3/1979 | Van Viliet | 313/570 |
| 4,260,929 | 4/1981 | Jacobs et al. | 313/570 |
| 4,605,881 | 8/1986 | Dakin . | |

FOREIGN PATENT DOCUMENTS

| | | | |
|---|---|---|---|
| 0097278 | 8/1978 | Japan | 313/642 |
| 0025085 | 8/1978 | Japan | 313/638 |
| 0091560 | 7/1980 | Japan | 313/572 |

OTHER PUBLICATIONS

"The High Pressure Sodium Lamp", de Groot et al., Philips Technical Library, pp. 172–175, 1/86.

Hirayama et al., "Complex Halide Vapors in Metal Halide Type Lamps", Journal of IES, Jul. 1977, pp. 209–214.

*Primary Examiner*—David K. Moore

*Assistant Examiner*—K. Wieder

*Attorney, Agent, or Firm*—Marvin Snyder; James C. Davis, Jr.

[57] ABSTRACT

High pressure xenon is used as a buffer gas in place of mercury in a high pressure sodium iodide arc discharge lamp. Xenon buffer gas has a more favorable influence than mercury on the sodium D-line spectrum and does not react with halides in the lamp fill. The use of xenon buffer gas increases the efficacy of the high pressure sodium iodide arc lamp.

6 Claims, 2 Drawing Sheets

HIGH PRESSURE METAL HALIDE ARC LAMP WITH XENON BUFFER GAS

This application is a continuation fo application Ser. No. 676.367, filed Nov. 29, 1984, now abandoned.

The present invention relates in general to high efficacy high pressure metal halide arc discharge lamps and more specifically to the use of xenon buffer gas at high pressure in a sodium iodide arc discharge lamp.

BACKGROUND OF THE INVENTION

In high intensity arc discharge lamps, the radiated light output is derived from a plasma arc discharge within an arc tube. One form of high intensity discharge lamp that is currently and conventionally employed is the metal halide lamp. In such lamps the arc discharge tube includes a metal halide, such as sodium iodide, which is vaporized and dissociated in the plasma arc during lamp operation. However, in the vicinity of the arc tube walls, where the temperature is cooler, sodium remains chemically bound to the iodide preventing the sodium from absorbing some of the light radiation. Without the added halide, the self-absorption characteristics of cooler sodium atoms distributed preferentially near the cooler arc tube walls would act to limit lamp efficacy. In particular, sodium D-line radiation produced within the hot central plasma region of the arc tube would be readily absorbed by the cooler sodium atoms which would be present near the arc tube walls.

While the addition of halides to the lamp reduces the presence of free sodium near the cooler arc tube walls, it also requires a buffer gas to limit the transport of energy from the hot core of the arc to the arc tube walls via chemical reaction. The conventional use of mercury to buffer the chemical transport of energy from the plasma arc to the arc tube walls requires very high mercury pressures. However, the use of high pressure mercury asymmetrically broadens the sodium D-line on the red side, enhancing non-efficacious radiation output. Further reduction of observed efficacy is presumed to be caused by the tying-up of iodine by the large excess of mercury buffer gas, especially in the cooler parts of the arc tube where mercury iodide is stable. It would be desirable to eliminate these drawbacks in high pressure sodium iodide arc discharge lamps.

OBJECTS OF THE INVENTION

It is a principal object of the present invention to buffer chemical transport of energy from the plasma arc to the arc tube walls in a sodium iodide arc discharge lamp with a buffer gas which has a favorable influence on the sodium D-line spectrum.

It is another object of the present invention to prevent tie-up of halide by the buffer gas in a high pressure metal halide arc discharge lamp.

It is yet another object of the present invention to improve the efficacy of the sodium iodide arc discharge lamp.

SUMMARY OF THE INVENTION

These and other objects are achieved by the disclosed fill in a high pressure metal halide arc lamp for supporting a plasma discharge, the fill comprising sodium iodide and xenon in a sufficient quantity to limit chemical transport of energy from the plasma discharge to the walls of the arc tube. In particular, the fill may be comprised of sodium iodide and possibly another metal halide, and xenon may be present in sufficient quantity to provide a partial pressure in the range of about 60 torr and higher at room temperature or about 600 torr and higher at the operating temperature of the lamp.

The present invention further contemplates a high intensity metal halide arc discharge lamp comprising an outer light transmissive envelope, a light transmissive arc discharge tube with electrodes at opposite ends of the arc tube and means to provide electrical connections to the electrodes. A vaporizable discharge medium is disposed within the arc tube, and includes sodium iodide together with xenon buffer gas in sufficient quantity to limit chemical transport of energy from the plasma discharge to the walls of the arc tube. The discharge medium may further contain a second metal halide.

The features and advantages of the present invention will become apparent from the following detailed description of the invention when read with the accompanying drawing.

DETAILED DESCRIPTION OF THE INVENTION

Figure 1:
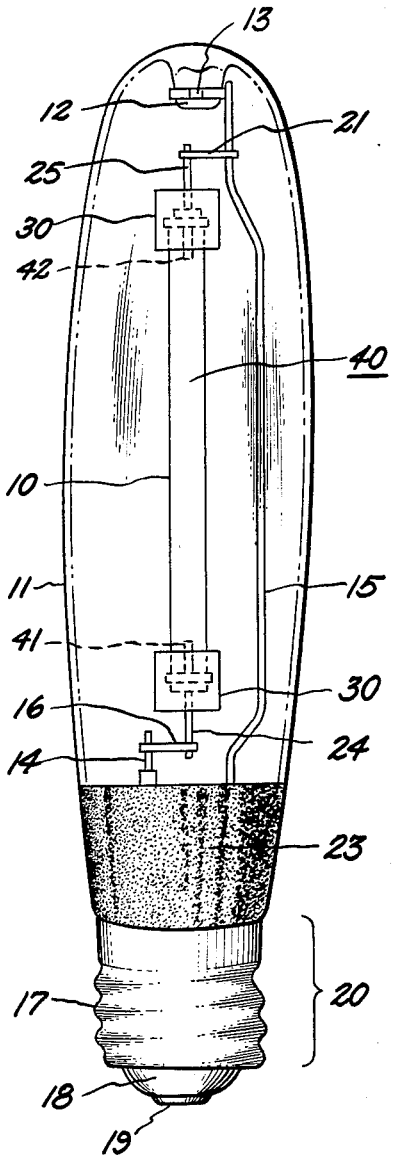
FIG. 1 is a side elevation view of a typical high pressure metal halide arc lamp in which the present invention may be embodied.

FIG. 1 shows a high intensity arc discharge lamp comprising an outer light transmissive envelope 11. This outer envelope preferably comprises a material such as heat resistant glass or silica. The lamp also comprises a light transmissive arc discharge tube 10 which has electrodes disposed internally at opposite ends thereof. Arc discharge tube 10 is typically configured in a cylindrical shape and must be resistant to attack by the materials employed in a gaseous discharge medium 40 contained within the arc tube. In particular, arc discharge tube 10 preferably comprises a refractory ceramic material such as sintered polycrystalline alumina, or may comprise fused quartz. Arc discharge tube 10 may have an internal diameter of about 5 to 20 millimeters and an arc gap of 50 to 150 millimeters, for example. The volume between arc discharge tube 10 and outer envelope 11 is generally evacuated to prevent efficacy robbing heat losses from arc tube 10. Getter material 23 may be disposed on the interior of outer envelope 11 to assist in maintaining vacuum conditions in the volume between arc tube 10 and outer envelope 11.

Structures are shown in FIG. 1 for providing electrical connection and support for arc tube 10. In particular, supporting wire conductors 14 and 15 provide part of a means for connecting the arc tube electrodes 41 and 42 to external connections. Supporting wire conductor 15 extends upward through the vacuum region of the lamp and is preferably welded to a hexagonal bracing washer or ring 13 which is disposed about a dimple 12 provided in the end of outer envelope 11 to furnish support for arc discharge tube 10. Lateral support wire 21 is preferably spot welded to an arc tube termination lead 25 and to supporting wire conductor 15. Similarly, at the base end of the lamp shown in FIG. 1, a lateral support 16 is spot welded to supporting wire conductor 14 and to a lower arc tube termination 24 so as not only to support arc tube 10 but also to supply electrical current to the electrodes therein. Thus, current through the gaseous discharge medium 40 typically follows a path defined by the following components: supporting wire conductor 14, lower lateral support 16, lower arc tube termination 24, lower electrode 41, gaseous discharge medium 40, the upper electrode 42, upper arc tube termination 25, lateral support wire 21, and supporting wire conductor 15. Supporting wire conductors 14 and 15 are separately connected to either of external screw base connection 17 or center exterior contact 19 on edison base 20. Insulating material 18 separates base connection 17 and exterior contact 19.

The lamp shown in FIG. 1 further includes heat shields 30 disposed about the ends of arc tube 10. These heat conserving end shields, made of heat reflecting material to minimize heat radiation from the ends of arc tube 10, are employed because metal halide lamps require a high temperature to maintain desired vapor pressures of the lamp fill ingredients.

Figure 2:
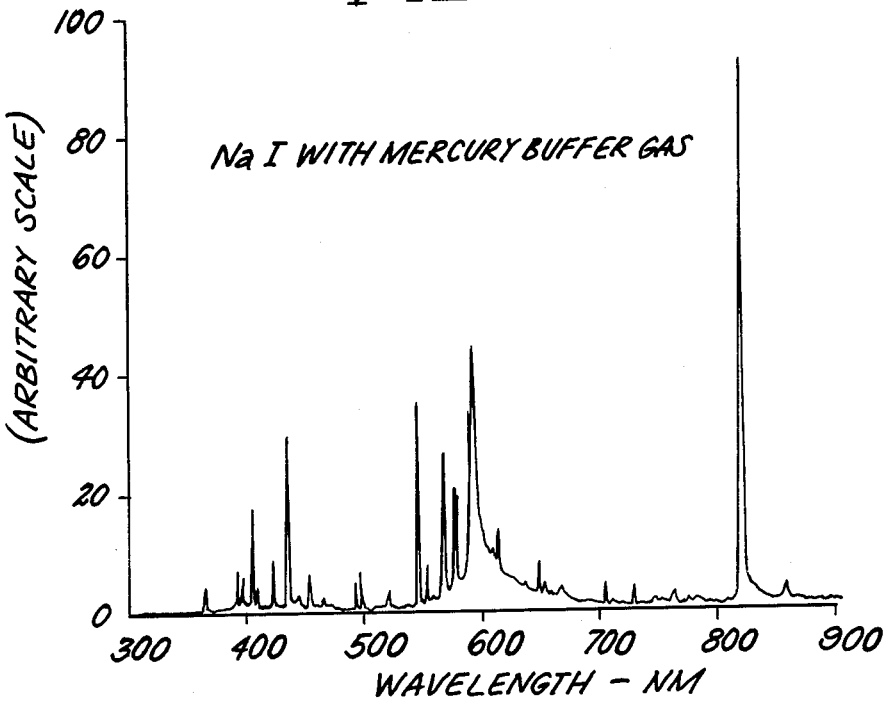
FIG. 2 PRIOR ART
FIG. 2 is a spectral diagram of a sodium iodide arc lamp with mercury buffer gas.

The spectral output of a conventional sodium iodide arc lamp with mercury buffer gas is shown in FIG. 2. This spectrum was obtained from a lamp wherein arc tube 10 was made of polycrystalline alumina and had a diameter (bore) of 0.72 cm and a distance between electrodes (arc gap) of 8.7 cm. Arc tube 10 was dosed with 30 mg sodium iodide, 32.7 mg of mercury, and xenon at a partial pressure of 20 torr at room temperature as a starting gas. This lamp was operated at a lamp power of 550 watts and obtained an efficacy of 64 lumens per watt. As shown in FIG. 2, the sodium D-line spectrum (in the vicinity of 600 nanometers) is broadened to red, longer wavelengths by the mercury buffer gas. Thus, the lamp radiance slopes off slowly as wavelength increases above the sodium D-line peak.

Returning to FIG. 1, gaseous discharge medium or fill 40 comprises sodium iodide and may also include a second metal halide. In accordance with the present invention, fill 40 also includes xenon buffer gas. The use of xenon as a buffer gas in the described lamp requires high buffer gas pressures. Due to the high breakdown voltage of high pressure xenon a somewhat more energetic arc starting mechanism is required than if mercury buffer gas is employed. Furthermore, the use of sodium iodide with xenon buffer gas in the present invention achieves best results with high cold spot temperatures, i.e. the temperature at the cooler arc tube walls in order to achieve a sodium vapor pressure in the arc of about 10 to 100 torr.

The chemical inertness, high excitation and ionization potentials, high atomic weight and large cross section for atom-to-atom collisions of xenon improve the efficacy of sodium iodide arc discharge lamps with respect to the use of mercury buffer gas. The use of high pressure xenon buffer gas results in an improved sodium-iodine atomic ratio throughout the plasma arc so as to facilitate molecular bonding to form sodium iodide, with reduced free atomic sodium in those parts of the arc tube near the walls and ends which are at cooler temperatures.

Figure 3:
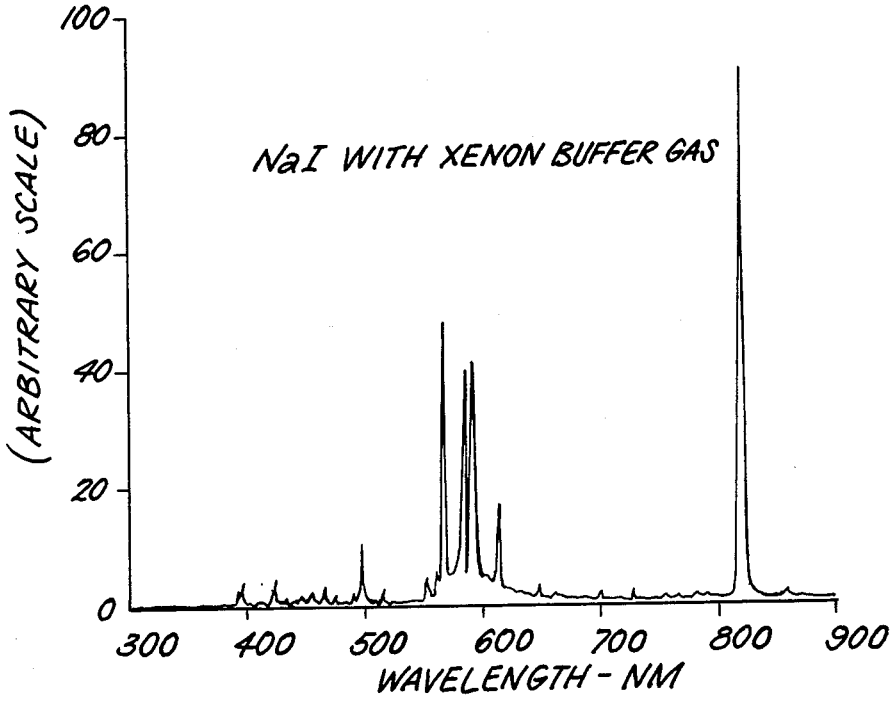
FIG. 3 is a spectral diagram of a sodium iodide arc lamp according to the present invention with xenon buffer gas.

The spectral output of a lamp with a fill according to the present invention is shown in FIG. 3. To provide a direct comparison between mercury buffer gas and xenon buffer gas, a lamp with identical dimensions to the lamp producing the spectrum of FIG. 2 (0.72 cm bore and 8.7 cm arc gap) was dosed with an equal amount of sodium iodide (30 mg). However, this lamp contained no mercury and contained xenon at a partial pressure of 250 torr at room temperature. When this lamp was operated at 550 watts, it achieved an efficacy of 100 lumens per watt (50 percent higher than the lamp with mercury buffer gas) and produced the spectrum shown in FIG. 3 which demonstrates a much more desirable D-line output. In this case, sodium D-line radiation is broadened to the blue, more efficacious wavelengths, due to the effect of xenon buffer gas.

In general, it is desirable to provide sufficient xenon in arc tube 10 so that the partial pressure of xenon under operating conditions of the lamp is about 600 torr and higher. This requires a xenon partial pressure at room temperature in the range of about 60 torr and higher. However, in a preferred embodiment of the invention, arc tube 10 has a bore of 1.2 cm, an arc gap of 8 cm, and is filled with 100 mg of sodium iodide and xenon at a partial pressure of 300 torr at room temperature.

It has been found that lamp efficacy in lamp lumens per watt increases as xenon fill pressure increases. However, a leveling off of efficacy improvement has been noted at a xenon partial pressure of about 1000 torr at room temperature. The following examples are provided which demonstrate other successfully tested fills for the high pressure metal halide arc lamp of the present invention.

EXAMPLE I

In this example, arc tube 10 had an internal diameter or bore of 0.72 cm. The arc gap or distance between electrodes was 8.7 cm. Arc tube 10 contained 18 milligrams of sodium iodide and a xenon partial pressure of 326 torr at room temperature. This lamp produced 107 lumens per watt at a lamp power of 550 watts.

EXAMPLE II

Another arc tube with a bore of 0.72 cm and an arc gap of 8.7 cm was filled with 30 milligrams sodium iodide and xenon at a partial pressure of 120 torr at room temperature. Running this lamp at 500 watts lamp power produced 108 lumens per watt.

EXAMPLE III

Another lamp having an arc tube 10 with a 0.72 cm bore and an arc gap of 8.7 cm was filled with 30 milligrams of sodium iodide and xenon at a partial pressure of 600 torr at room temperature. Running this lamp at 550 watts lamp power produced an efficacy of 134 lumens per watt.

EXAMPLE IV

A further lamp wherein arc tube 10 had a bore of 0.72 cm and an arc gap of 8.7 cm was filled with 30.02 milligrams of sodium iodide, 1.73 milligrams of scandium iodide and xenon at a partial pressure of 400 torr at room temperature and had an efficacy of 88 lumens per watt at 500 watts lamp power.

The foregoing describes a high pressure sodium iodide arc lamp and a fill for such lamp wherein xenon is chosen as the buffer gas rather than mercury as in conventional arc lamps. Thus, tie-up of halide is prevented and efficacy is improved through use of xenon buffer gas which also results in a favorably influenced sodium D-line spectrum. Other metal halides may be added to the fill in order to provide improved color or for other reasons. However, fluorides would typically not be useful because of their great proclivity to attack and erode the material of arc discharge tube 10 and the electrodes.

While preferred embodiments of the present invention have been shown and described herein, it will be obvious that such embodiments are provided by way of example only. Numerous variations, changes and substitutions will occur to those skilled in the art without departing from the invention herein. Accordingly, it is intended that the invention be limited only by the spirit and scope of the appended claims.

what is claimed is:

1. In a high pressure metal halide arc lamp having an arc tube for containing an arc discharge, an arc tube fill substantially free of mercury and comprising:

sodium iodide in a sufficient quantity to provide a sodium partial pressure in said arc discharge during lamp operation in the range of about 10 torr to about 100 torr; and xenon in a sufficient quantity to limit the chemical transport of energy from said arc discharge to the walls of said arc tube.

2. The lamp of claim 1 wherein said fill further comprises a second metal halide.

3. The lamp of claim 1 wherein said quantity of xenon provides a partial pressure in the range of about 60 torr and higher at room temperature.

4. The lamp of claim 1 wherein said quantity of xenon provides a partial pressure in the range of about 600 torr and higher at the operating temperature of said lamp.

5. A high intensity arc discharge lamp comprising:

an outer light transmissive envelope;

a light transmission arc discharge tube situated within said envelope and having electrodes at opposite ends thereof, the interior of said tube being substantially free of mercury;

means to provide electrical connection to said electrodes;

sodium iodide disposed within said arc tube in a sufficient quantity to provide a sodium partial pressure in an arc discharge during lamp operation in the range of about 10 torr to about 100 torr; and xenon disposed within said arc tube in a quantity which provides xenon partial pressure in the range of about 600 torr and higher at the operating temperature of said lamp.

6. The lamp of claim 5 including a second metal halide also disposed within said arc tube.

* * * * *